US011732885B2

(12) United States Patent
Ino

(10) Patent No.: US 11,732,885 B2
(45) Date of Patent: Aug. 22, 2023

(54) ECONOMIZER

(71) Applicant: Tadayuki Ino, Saitama (JP)

(72) Inventor: Tadayuki Ino, Saitama (JP)

(73) Assignee: Takayuki Ino, Tokyo (JP)

( * ) Notice: Subject to any disclaimer, the term of this patent is extended or adjusted under 35 U.S.C. 154(b) by 183 days.

(21) Appl. No.: 17/602,188

(22) PCT Filed: May 23, 2019

(86) PCT No.: PCT/JP2019/020532
§ 371 (c)(1),
(2) Date: Oct. 7, 2021

(87) PCT Pub. No.: WO2020/217545
PCT Pub. Date: Oct. 29, 2020

(65) Prior Publication Data

US 2022/0205631 A1 Jun. 30, 2022

(30) Foreign Application Priority Data

Apr. 22, 2019 (JP) ..... 2019-081003

(51) Int. Cl.
*F22D 1/02* (2006.01)
*F22B 1/18* (2006.01)
(Continued)

(52) U.S. Cl.
CPC ..... *F22D 1/02* (2013.01); *F22B 1/1869* (2013.01); *F22B 37/12* (2013.01); *F22B 37/40* (2013.01);
(Continued)

(58) Field of Classification Search
CPC ..... F22B 1/1869; F22B 37/10; F22B 37/12; F22B 37/40; F22B 37/48; F22D 1/02; F22D 1/24
(Continued)

(56) References Cited

U.S. PATENT DOCUMENTS 1,746,564 A * 2/1930 Summers ..... F22D 1/24 38/73
1,948,550 A * 2/1934 Voorheis ..... F23K 5/20 165/68
(Continued)

FOREIGN PATENT DOCUMENTS

CN 2795676 Y 7/2006
CN 204718131 U 10/2015
(Continued)

OTHER PUBLICATIONS

Office Action, for Korean Patent Application No. 10-2021-7033000, dated Apr. 10, 2023, 14 pages.
(Continued)

*Primary Examiner* — Steven B McAllister
*Assistant Examiner* — Benjamin W Johnson
(74) *Attorney, Agent, or Firm* — Westman, Champlin & Koehler, P.A.

(57) ABSTRACT

An economizer having a structure capable of efficiently warming water and facilitating inspection and cleaning is obtained.
In an economizer for warming water by combustion exhaust gas generated by a boiler, to a cylindrical water pipe in which an inflow port and an outflow port are formed on a side surface and through which the water passes, a plurality of gas pipes erected for circulating the combustion exhaust gas are arranged in corresponding fan-shaped portions of the water pipe. The combustion exhaust gas introduced from a bottom surface side of the water pipe folds back at an upper part of the water pipe and flows downward, then folds back at a lower part of the water pipe, flows upward, and flows out from an upper surface side of the water pipe, whereby the plurality of gas pipes efficiently warms the water in the water pipe.

8 Claims, 15 Drawing Sheets

(51) Int. Cl.

| | |
|---|---|
| ***F22B 37/12*** | (2006.01) |
| ***F22B 37/40*** | (2006.01) |
| ***F22B 37/48*** | (2006.01) |
| *F22B 37/10* | (2006.01) |
| *F22D 1/24* | (2006.01) |

(52) U.S. Cl.
CPC ..... *F22B 37/48* (2013.01); *F22B 37/10* (2013.01); *F22D 1/24* (2013.01)

(58) Field of Classification Search
USPC ..... 122/444
See application file for complete search history.

(56) References Cited

U.S. PATENT DOCUMENTS

| | | | | |
|---|---|---|---|---|
| 2,416,273 | A * | 2/1947 | Wallis | F22D 1/08 165/DIG. 405 |
| 4,138,969 | A * | 2/1979 | Thompson | F28F 11/00 122/421 |
| 4,998,508 | A | 3/1991 | Stead | |
| 10,197,266 | B2 * | 2/2019 | Gauthier | F22D 1/02 |
| 2017/0211845 | A1 * | 7/2017 | Deal | F28D 7/1638 |

FOREIGN PATENT DOCUMENTS

| | | | | |
|---|---|---|---|---|
| CN | 105823210 | A | | 8/2016 |
| CN | 207455895 | U | | 6/2018 |
| DE | 1 576 794 | A | | 5/1970 |
| GB | 937301 | A | * | 9/1963 |
| JP | S60-66904 | U | | 5/1985 |
| JP | H02-71003 | A | | 3/1990 |
| JP | 3587895 | B2 | | 8/2004 |
| JP | 2016099047 | A | | 5/2016 |
| KR | 20040091867 | A | | 11/2004 |
| KR | 10-0818414 | B1 | | 4/2008 |
| KR | 20130001433 | A | | 1/2013 |
| KR | 20160102346 | A | | 8/2016 |
| WO | 2013128484 | A1 | | 9/2013 |

OTHER PUBLICATIONS

Office Action, including Search Report, for Chinese Patent Application No. 201980095676.4, dated Feb. 7, 2023, 9 pages.
International Search Report (including English translation) and Written Opinion for International Application No. PCT/JP2019/020532, dated Aug. 13, 2019, 20 pages.
Extended European Search Report, for European Patent Application No. 19926723.8, dated Dec. 19, 2022, 7 pages.

* cited by examiner

PRIOR ART

ECONOMIZER

CROSS-REFERENCE TO RELATED APPLICATION(S)

This application is a Section 371 National Stage application of international application number PCT/JP2019/020532, filed 23 May 2019, which published as WO 2020/217545 A1, on 29 Oct. 2020, the contents of which are hereby incorporated by reference in their entireties.

TECHNICAL FIELD

The present invention relates to an economizer for preheating water supplied to a boiler by combustion exhaust gas of the boiler.

BACKGROUND ART

The economizer for preheating water supplied to a boiler with heat of combustion exhaust gas discarded from the boiler is widely and generally used because the heat can be effectively used.

For example, an economizer (FIG. 17) described in Patent Document 1 is configured such that a large number of water tubes are arranged in a flue 2 through which combustion exhaust gas generated by a boiler 1 flows, and water flowing within each water tube is heated by heat exchange. Further, by U-shaped tubes 4 outside the flue and providing end plates 5 outside the flue, the path of the water tubes is folded back to pass through the flue 2 again in the opposite direction, and by repeating this, the path is made longer. The water tubes in the flue 2 are provided with a large number of fin tubes 3 in order to improve heat absorption.

According to the economizer described in Patent Document 1, in the flue 2 connected to the boiler 1, a large number of vertical water tubes are arranged in the flue by folding back the water supply path at the upper part and the lower part of the flue, and at least lower folded back portions (U-shaped tubes 4) are provided inside the flue. A spray nozzle 7 for injecting blow water from the boiler 1 via a blow pipe 6 is arranged toward the water tubes in the flue, whereby the blow water is sprayed toward the water tubes and the blow water is stored in a water tank (water part 9) at the lower part of the flue so that the folded back portions are immersed in the water, and the water overflowing the water tank is drained from a drain pipe 8.

CITATION LIST

Patent Document

Patent Document 1: Japanese Patent No. 3587895

SUMMARY OF INVENTION

Technical Problems

According to the structure of the conventional economizer, there is a problem that the water within the water tubes is warmed by the water supply path (water tubes) arranged in the flue 2, so that the heat absorption efficiency of the water flowing within the water tubes is poor and warming cannot be performed as expected. Further, there is a structural problem that there is a limit to the amount of warmed water held (for example, 10 to 20 liters) due to the small volume of the water tubes and sufficient warming cannot be maintained when the amount of water supplied per hour increases.

Further, there is a problem that the combustion exhaust gas comes into contact with the fin tubes 3 that are protrusions provided outside the water tubes, so that dirt easily adheres and is difficult to remove.

Therefore, the present inventor has proposed an economizer (Japanese Patent Application No. 2019-054551) shown in FIG. 14 to FIG. 16 as a structure capable of efficiently warming water.

The economizer is provided with a combustion exhaust gas introduction chamber 20 facing a combustion exhaust gas introduction port 15, at a lower end position in a cylindrical water pipe 11 in which an inflow port 12 and an outflow port 13 are formed on a side surface and through which water passes, a lower connection chamber 30 partitioned from the combustion exhaust gas introduction chamber 20, a combustion exhaust gas discharge chamber 40 facing a combustion exhaust gas exhaust port 19, at an upper end position in the water pipe, and an upper annular connection chamber 50 partitioned from the combustion exhaust gas discharge chamber 40 and surrounding the combustion exhaust gas discharge chamber 40.

In order to circulate the combustion exhaust gas in the water pipe 11, there are provided a plurality of first gas pipes 61 erected penetrating a lower partition wall 14 and an upper partition wall 17 along the circumference of an inner wall of the water pipe 11 so as to connect the combustion exhaust gas introduction chamber 20 and the upper annular connection chamber 50, a plurality of second gas pipes 62 erected penetrating the lower partition wall 14 and the upper partition wall 17 at inner positions of the first gas pipes 61 so as to connect the upper annular connection chamber 50 and the lower connection chamber 30, and a plurality of third gas pipes 63 erected penetrating the lower partition wall 14 and the upper partition wall 17 at inner positions of the second gas pipes 62 so as to connect the lower connection chamber 30 and the combustion exhaust gas discharge chamber 40, whereby the water is warmed using the combustion exhaust gas generated by the boiler.

The lower partition wall 14 having a disc shape is attached to a lower position in the cylindrical water pipe 11 through which the water passes, and the combustion exhaust gas introduction chamber 20 facing the combustion exhaust gas introduction port 15 formed at the lower end position of the water pipe 11 is formed.

The lower connection chamber 30 partitioned from the combustion exhaust gas introduction chamber 20 is formed by closing a lower surface side of the lower partition wall 14 with a conical lid portion 16. Since the lower connection chamber 30 is closed with the conical lid portion 16, the lower connection chamber 30 is composed of a conical space projecting toward the combustion exhaust gas introduction chamber side.

The upper partition wall 17 having a disc shape is attached to an upper position in the water pipe 11, and an annular partition wall 18 is attached between the upper partition wall 17 and the rear surface of the top plate of the water pipe 11, whereby the combustion exhaust gas discharge chamber 40 facing the combustion exhaust gas exhaust port 19 formed at the upper end position of the water pipe 11 and the upper annular connection chamber 50 surrounding the combustion exhaust gas discharge chamber 40 are formed.

According to the above structure, in the plurality of gas pipes 61, 62, 63, the water in the water pipe 11 is warmed by heat exchange at the time when the combustion exhaust gas introduced from the bottom surface side of the water pipe 11 folds back at the upper part of the water pipe 11, flows downward, folds back at the lower part of the water pipe 11, flows upward, and flows out from the upper surface side of the water pipe 11.

The plurality of first gas pipes 61 and the plurality of second gas pipes 62 are annularly arranged in a row in the water pipe 11 with the number of pipes and the sum total of cross-sectional areas being the same, so that the number of gas pipes that can be arranged may be limited. For example, in the above example, the number of third gas pipes 63 that can be arranged inside the annular partition wall 18 by welding is limited in order to secure the welding work, so that the number of first gas pipes 61 and second gas pipes 62 is determined accordingly. Since the first gas pipes 61 are also arranged in a row, the arrangement density is lower than that of the second gas pipes 62. Therefore, there is a problem that it hindered effective warming by maximizing the number of arrangements.

Accordingly, the present invention has been proposed in view of the above circumstances, and an object thereof is to provide an economizer having a structure capable of installing the maximum number of gas pipes in the same area to effectively warm water and facilitating inspection and cleaning.

Solution to Problems

The present invention to achieve the above object is an economizer for warming water by combustion exhaust gas generated by a boiler, including:

a cylindrical water pipe (11) in which an inflow port (12) and an outflow port (13) are formed on a side surface and through which the water passes, a combustion exhaust gas introduction pipe (20) connected to a lower end position of the water pipe (11) via a partition wall (lower partition wall 14), a combustion exhaust gas discharge pipe (40) connected to an upper end position of the water pipe (11) via a partition wall (upper partition wall 17), wherein the inside of the combustion exhaust gas introduction pipe is partitioned into a combustion exhaust gas introduction chamber (A) facing a gas introduction port (combustion exhaust gas introduction port 15) and a lower combustion exhaust gas passage chamber (B), and the inside of the combustion exhaust gas discharge pipe is partitioned into a combustion exhaust gas discharge chamber (C) facing a gas exhaust port (combustion exhaust gas exhaust port 19) and an upper combustion exhaust gas passage chamber (D), a plurality of first gas pipes (61) erected in the water pipe, penetrating the partition walls so as to communicate the combustion exhaust gas introduction chamber (A) and the upper combustion exhaust gas passage chamber (D), a plurality of second gas pipes (62) erected in the water pipe, penetrating the partition walls so as to communicate the upper combustion exhaust gas passage chamber (D) and the lower combustion exhaust gas passage chamber (B), and a plurality of third gas pipes (63) erected in the water pipe, penetrating the partition walls so as to communicate the lower combustion exhaust gas passage chamber (B) and the combustion exhaust gas discharge chamber (C).

Further, the combustion exhaust gas introduction chamber is formed with an area where the combustion exhaust gas introduction pipe is divided into three parts in a horizontal plane, and the combustion exhaust gas discharge chamber is formed with an area where the combustion exhaust gas discharge pipe is divided into three equal parts in a horizontal plane, so that passages where the first gas pipes, the second gas pipes, and the third gas pipes are erected each have the same area.

On the other hand, the economizer includes a bottom surface lid (attaching/detaching portion 21*b*) detachably attached to a position excluding the gas introduction port (15) provided on a lower surface side of the combustion exhaust gas introduction pipe (20), and an upper surface lid (attaching/detaching portion 41*b*) detachably attached to a position excluding the gas exhaust port (19) provided on an upper surface side of the combustion exhaust gas discharge pipe (40).

As a result, upper ends of the first gas pipes (61), both ends of the second gas pipes (62), and lower ends of the third gas pipes (63) can be inspected in a state in which the bottom surface lid (attaching/detaching portion 21*b*) and the upper surface lid (attaching/detaching portion 41*b*) are removed.

The present invention is characterized in that, instead of the bottom surface lid (attaching/detaching portion 21*b*) and the upper surface lid (attaching/detaching portion 41*b*), the gas exhaust port (19) is provided on a side surface side of the combustion exhaust gas discharge pipe (40) to allow an upper surface of the combustion exhaust gas discharge pipe (40) to be opened by opening and closing operation of a top plate (41), so that upper ends of the first gas pipes (61), the second gas pipes (62), and the third gas pipes (63) can be inspected when the top plate is opened.

The present invention is characterized in that a cleaning pipe (85) is connected to a lower surface of the lower combustion exhaust gas passage chamber (B).

The present invention is characterized in that the combustion exhaust gas introduction chamber (A) and the combustion exhaust gas discharge chamber (C) are fan-shaped in a horizontal plane.

The present invention is characterized in that a total of cross-sectional areas of the first gas pipes (61), a total of cross-sectional areas of the second gas pipes (62), and a total of cross-sectional areas of the third gas pipes (63) are equal to one another.

The present invention is characterized in that the first gas pipes (61), the second gas pipes (62), and the third gas pipes (63) are equal in number to one another.

The present invention is characterized in that the inflow port (12) is formed at a lower position of the side surface of the water pipe, and the outflow port (13) is formed at an upper position of the side surface of the water pipe.

The present invention is characterized in that the water pipe (11) is composed of a pressure water container.

Effects of Invention

According to the economizer of the present invention, the plurality of gas pipes (61, 62, 63) erected for circulating the combustion exhaust gas are arranged in the water pipe (11), whereby water supplied into the water pipe is efficiently warmed around the gas pipes.

Further, the first gas pipes (61), the second gas pipes (62), and the third gas pipes (63) can be arranged in the regions (fan-shaped portions) where the water pipe (11) is divided into three parts in the horizontal plane without considering the arrangement positions of the other gas pipes, so that a large number of gas pipes can be installed in each fan-shaped portion.

By configuring so that each opening on the upper end side of the first gas pipes (61) and the second gas pipes (62) and each opening on the lower end side of the second gas pipes (62) and the third gas pipes (63) can be inspected by removing only the upper surface lid (attaching/detaching portion 41*b*) and the bottom surface lid (attaching/detaching portion 21*b*), inspection and cleaning of the inside of each gas pipe can be performed easily.

According to the present invention, by providing the gas exhaust port (19) on the side surface side of the combustion exhaust gas discharge pipe (20), the top plate (41) allowing the entire upper surface of the combustion exhaust gas discharge pipe (20) to be opened can be provided and the upper ends of the first gas pipes (61), the second gas pipes (62), and the third gas pipes (63) can be inspected when the top plate (41) is opened.

According to the present invention, by connecting the cleaning pipe (85) to the lower surface of the lower combustion exhaust gas passage chamber (B), water can be recovered from the cleaning pipe (85) via the lower combustion exhaust gas passage chamber (B) and discharged when it is injected from the upper ends of the second gas pipes (62) and the third gas pipes (63) while cleaning.

According to the present invention, the regions where the water pipe (11) is divided into three parts in the horizontal plane can be fan-shaped.

According to the present invention, by equalizing the sum total of cross-sectional areas of the first gas pipes (61), the second gas pipes (62), and the third gas pipes (63), the generation of resistance can be suppressed and the combustion exhaust gas can be made to easily flow when the combustion exhaust gas flows from the gas pipe to the gas pipe.

According to the present invention, by equalizing the number of each of the first gas pipes (61), the second gas pipes (62), and the third gas pipes (63), the first gas pipes, the second gas pipes, and the third gas pipes can be made the same in size.

According to the present invention, by forming the inflow port (12) at the lower position and forming the outflow port (13) at the upper position, the warmed water can easily flow out.

According to the present invention, by forming the water pipe (11) composed of a pressure water container, the warmed water can be brought to a temperature of 100° C. or higher.

DESCRIPTION OF EMBODIMENTS

Figure 14:
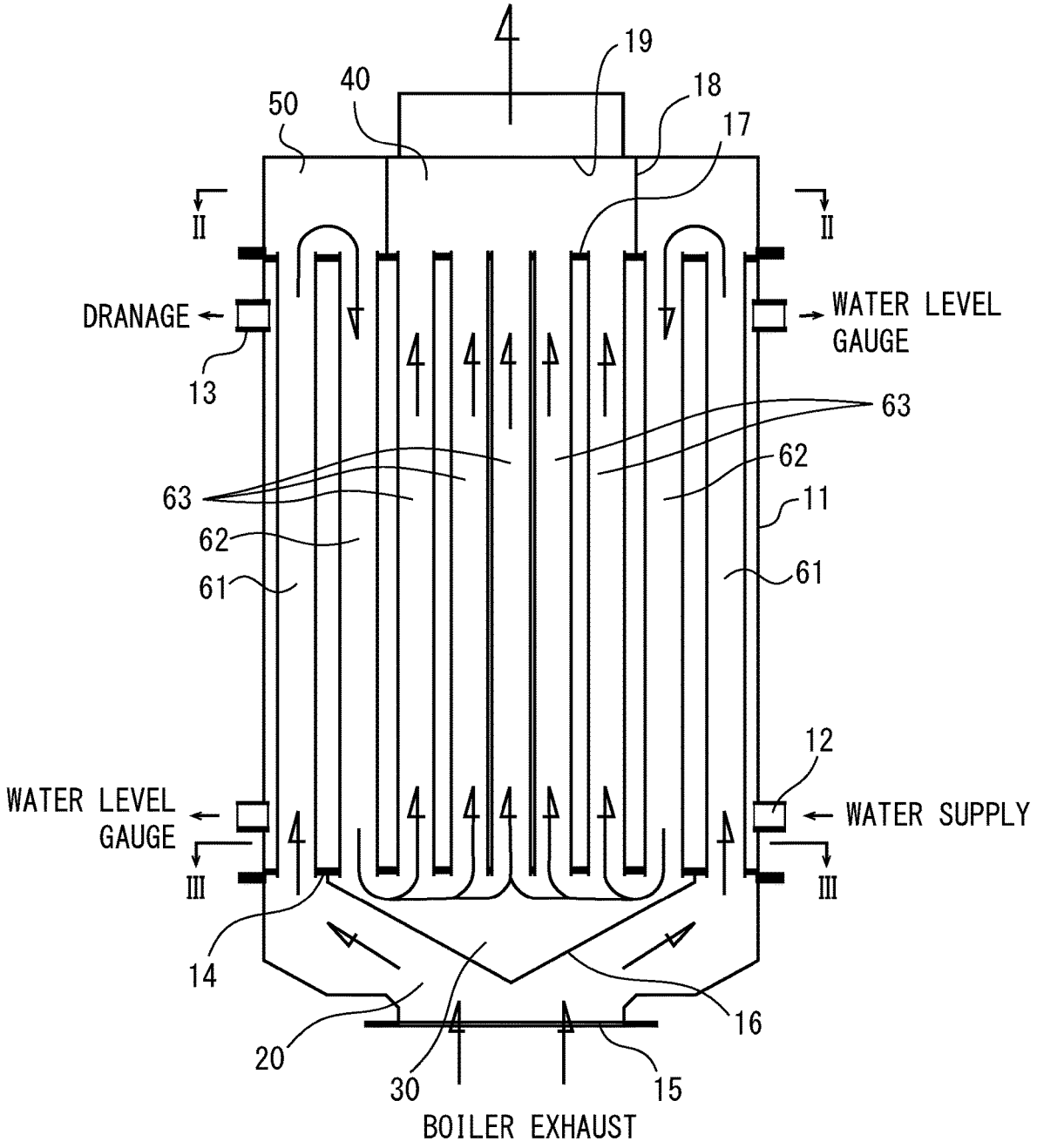
FIG. 14 is a longitudinal sectional explanatory diagram of an economizer proposed by the present inventor.
Figure 15:
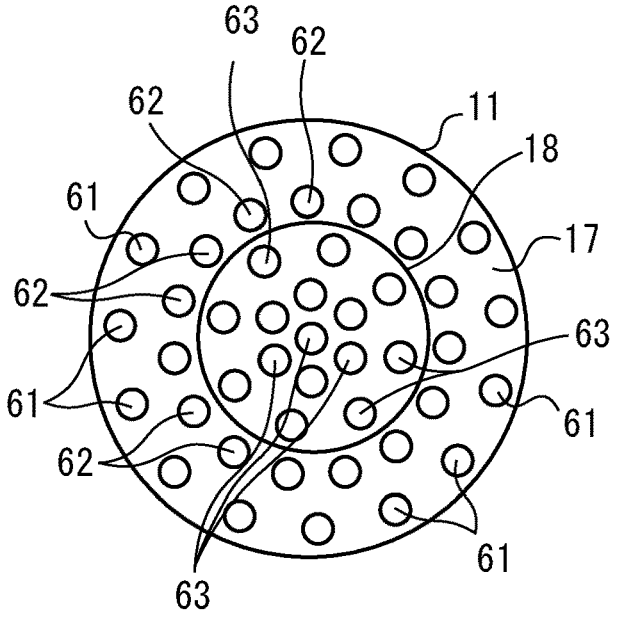
FIG. 15 is a cross-sectional explanatory diagram taken along line II-II of FIG. 8.
Figure 16:
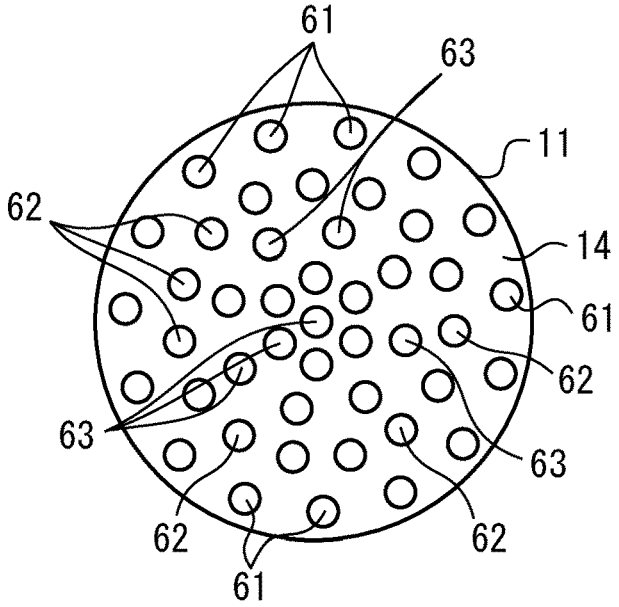
FIG. 16 s a cross-sectional explanatory diagram taken along line of FIG. 8.
Figure 17:
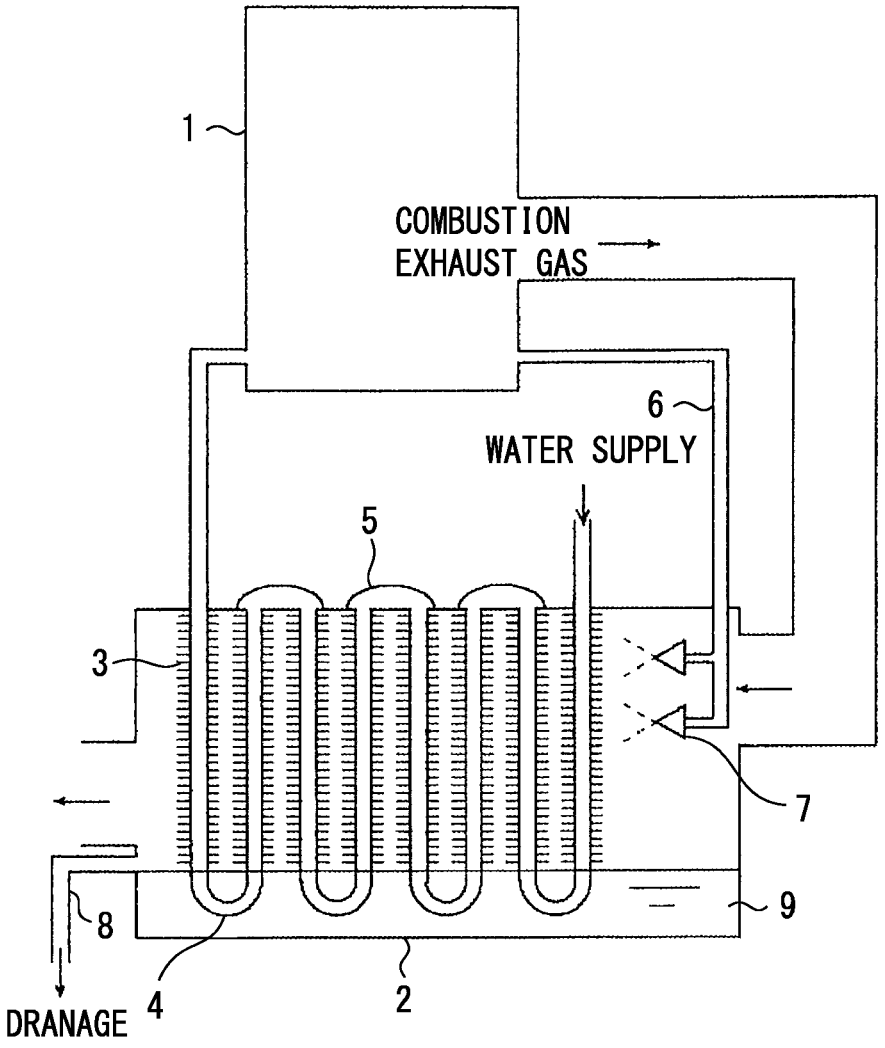
FIG. 17 is a configuration explanatory diagram showing a structure of a conventional economizer.

An example of an embodiment of an economizer according to the present invention will be described with reference to FIG. 1 to FIG. 6. In FIG. 1 to FIG. 6, parts having the same configurations as those in FIG. 14 to FIG. 16 are denoted by the same reference signs.

Figure 1:
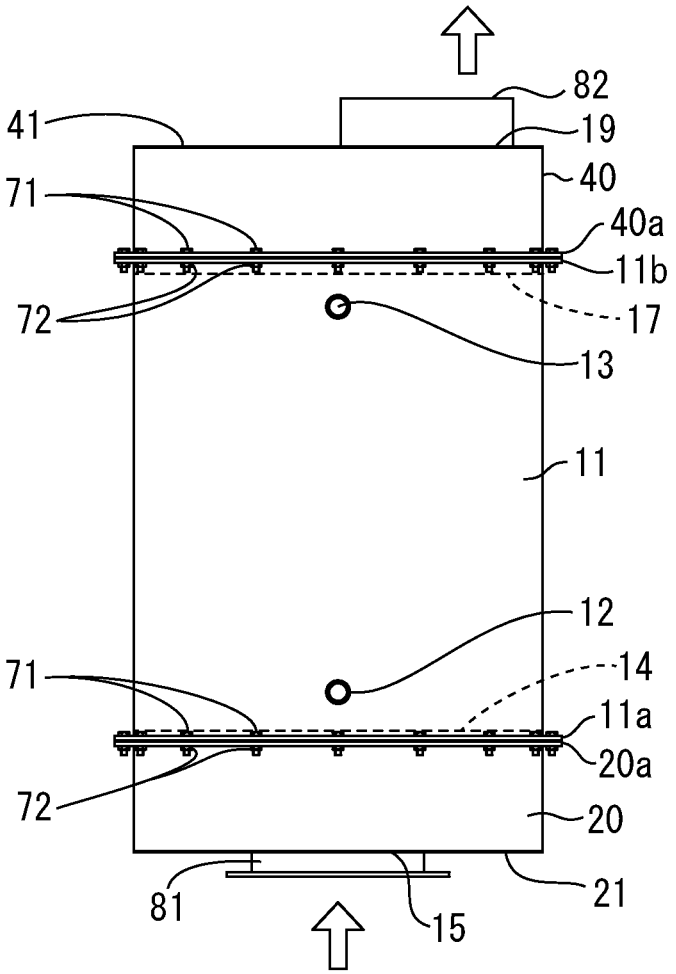
FIG. 1 is a front explanatory diagram of an economizer of the present invention.

An economizer warms water by combustion exhaust gas generated by a boiler, and as shown in FIG. 1, three inflow ports 12 and three outflow ports 13 are formed on a side surface of a cylindrical water pipe (water container) 11. The inflow ports 12 are formed at lower positions on the side surface of the water pipe at 120 degree intervals, and the outflow ports 13 are formed at upper positions on the side surface of the water pipe at 120 degree intervals, and water (feedwater) supplied from the three inflow ports 12 is configured to be warmed up inside the water pipe to rise and flow out (be drained) from the three outflow ports 13.

Figure 2:
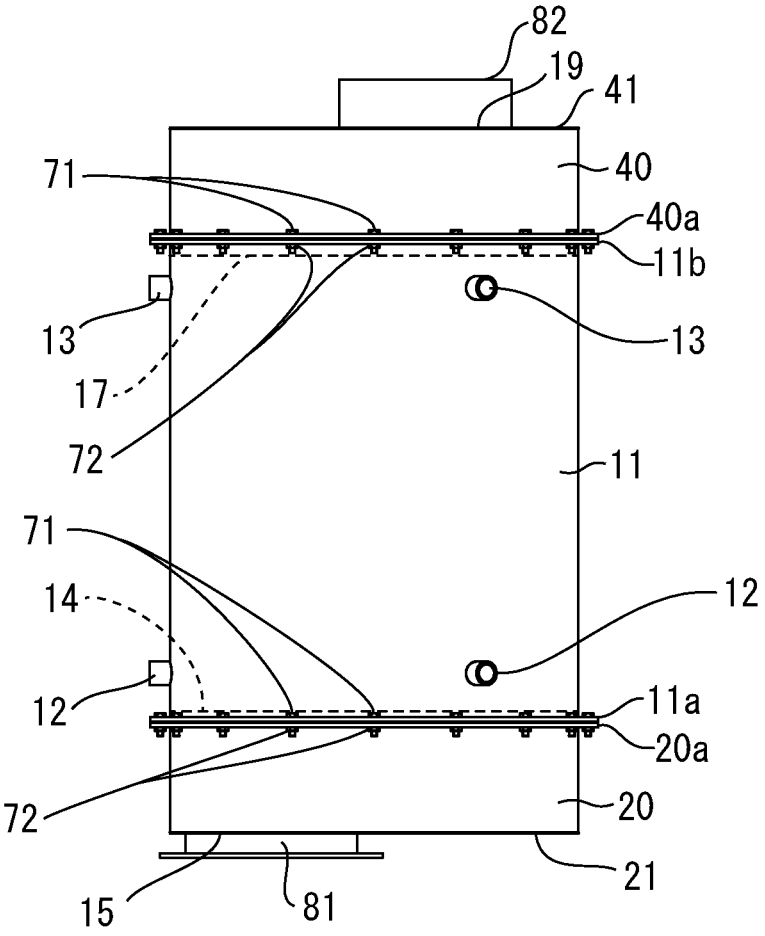
FIG. 2 is a side explanatory diagram of the economizer of the present invention.
Figure 4:
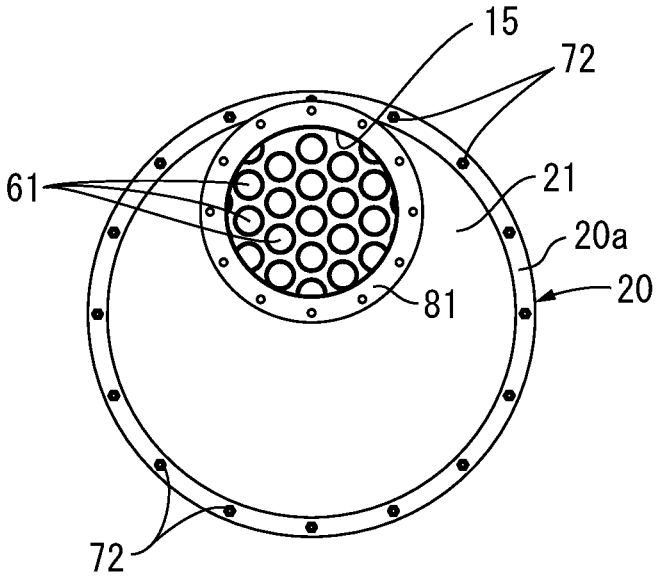
FIG. 4 is a bottom explanatory diagram of the economizer of the present invention.

A disc-shaped lower partition wall 14 is attached at a lower end position in the cylindrical water pipe 11 through which the water passes, and a combustion exhaust gas introduction pipe 20 having the same diameter as the water pipe 11 is connected and fixed with flange portions (flange portion 11*a* and flange portion 20*a*) facing each other so as to cover the lower partition wall 14. The combustion exhaust gas introduction pipe 20 is closed by a bottom plate 21, and a combustion exhaust gas introduction port 15 is formed in the bottom plate 21 (FIG. 1, FIG. 2, and FIG. 4). An introduction gas pipe 81 connected to the combustion exhaust gas introduction port 15 is vertically erected on the bottom plate 21.

The connection between the water pipe 11 and the combustion exhaust gas introduction pipe 20 is such that the flange portion 11*a* formed on the water pipe 11 and the flange portion 20*a* formed on the combustion exhaust gas introduction pipe 20 are facing each other and detachably connected and fixed by a plurality of bolts 71 and nuts 72.

Figure 5:
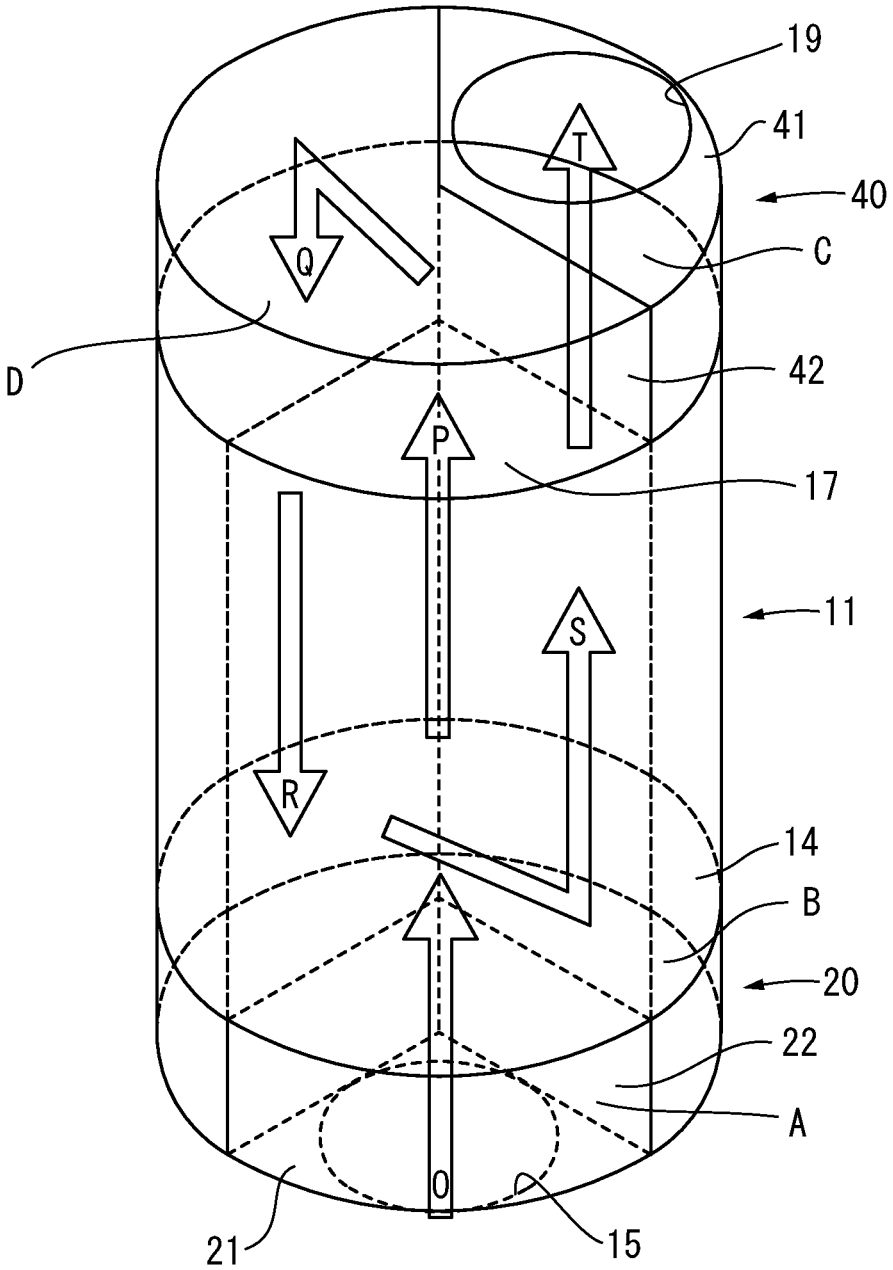
FIG. 5 is a model diagram for explaining the flow direction of combustion exhaust gas flowing within a plurality of gas pipes installed in a water pipe.

The inside of the combustion exhaust gas introduction pipe 20 is partitioned into a combustion exhaust gas introduction chamber A facing the combustion exhaust gas introduction port 15 and a lower combustion exhaust gas passage chamber B by a vertical lower partition wall 22 (FIG. 5). The vertical lower partition wall 22 is formed of a bent piece bent at an angle of 120 degrees at the center, so that the combustion exhaust gas introduction chamber A is partitioned to have one-third the area of the combustion exhaust gas introduction pipe 20 in a horizontal plane.

Figure 3:
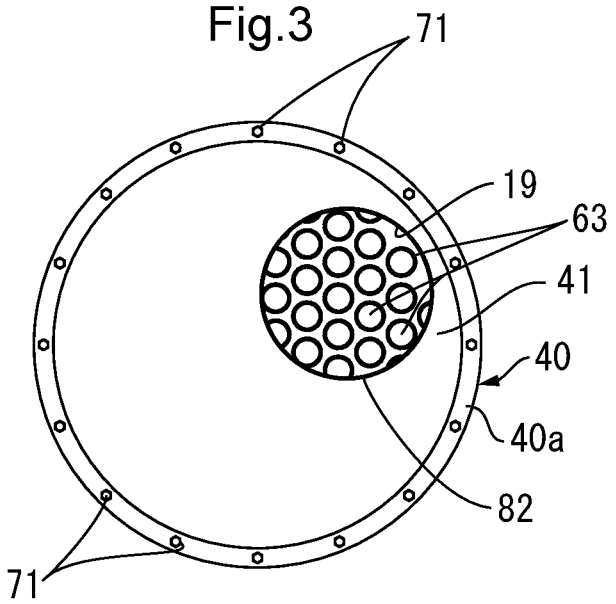
FIG. 3 is a plan explanatory diagram of the economizer of the present invention.

A disc-shaped upper partition wall 17 is attached to an upper end position in the water pipe 11, and a combustion exhaust gas discharge pipe 40 having the same diameter as the water pipe 11 is connected and fixed with flange portions (flange portion 11*b* and flange portion 40*a*) facing each other so as to cover the upper partition wall 17. The combustion exhaust gas discharge pipe 40 is closed by a top plate 41, and a combustion exhaust gas exhaust port 19 is formed in the top plate 41 (FIG. 1 to FIG. 3).

The connection between the water pipe 11 and the combustion exhaust gas discharge pipe 40 is such that the flange portion 11*b* formed on the water pipe 11 and the flange portion 40*a* formed on the combustion exhaust gas discharge pipe 40 are facing each other and detachably connected and fixed by a plurality of bolts 71 and nuts 72. An exhaust gas pipe 82 connected to the combustion exhaust gas exhaust port 19 is vertically erected on the top plate 41.

The inside of the combustion exhaust gas discharge pipe 40 is partitioned into a combustion exhaust gas discharge chamber C facing the combustion exhaust gas exhaust port 19 and an upper combustion exhaust gas passage chamber D by a vertical upper partition wall 42 (FIG. 5). The vertical upper partition wall 42 is formed of a bent piece bent at an angle of 120 degrees at the center, so that the combustion exhaust gas discharge chamber C is partitioned to have one-third the area of the combustion exhaust gas discharge pipe 40 in a horizontal plane.

A plurality of gas pipes are arranged in the water pipe 11 in order to circulate the combustion exhaust gas.

Figure 6A:
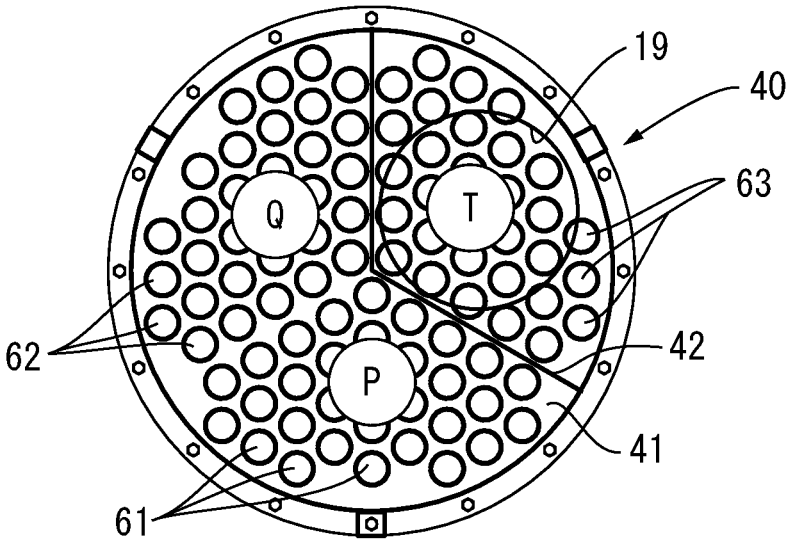
FIG. 6A is a cross-sectional explanatory diagram of a combustion exhaust gas discharge pipe of the economizer.
Figure 6B:
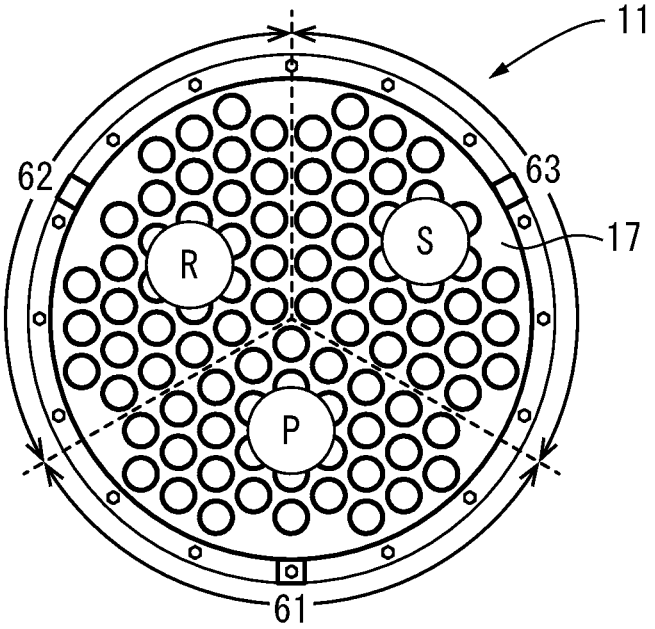
FIG. 6B is a cross-sectional explanatory diagram of a water pipe of the economizer.
Figure 6C:
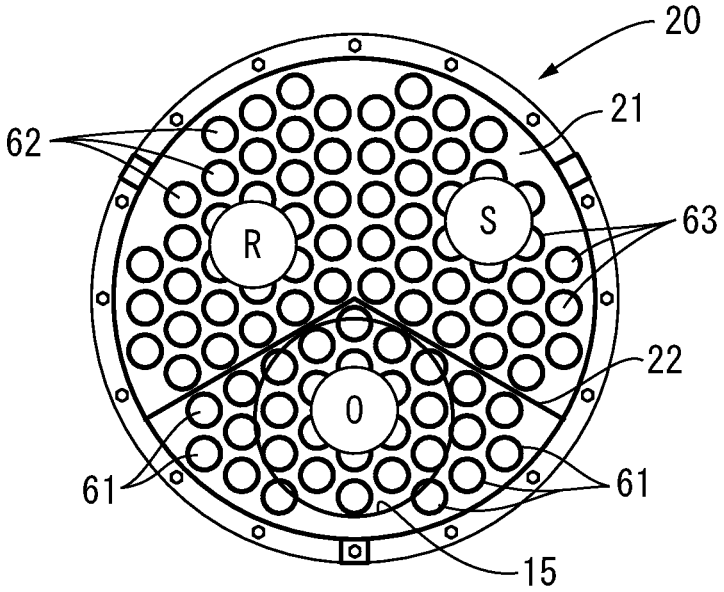
FIG. 6C is a cross-sectional explanatory diagram of a combustion exhaust gas introduction pipe of the economizer.

As shown in FIG. 6A, FIG. 6B, and FIG. 6C, the gas pipes are composed of a plurality of first gas pipes 61 erected in a one-third area portion (fan shape) of the horizontal plane of the water pipe 11 so as to penetrate the lower partition wall 14 and the upper partition wall 17 and connect the combustion exhaust gas introduction chamber A and the upper combustion exhaust gas passage chamber D, a plurality of second gas pipes 62 erected in a one-third area portion (fan shape) of the horizontal plane of the water pipe 11 so as to penetrate the lower partition wall 14 and the upper partition wall 17 and connect the upper combustion exhaust gas passage chamber D and the lower combustion exhaust gas passage chamber B, and a plurality of third gas pipes 63 erected in a one-third area portion (fan shape) of the horizontal plane of the water pipe 11 so as to penetrate the lower partition wall 14 and the upper partition wall 17 and connect the lower combustion exhaust gas passage chamber B and the combustion exhaust gas discharge chamber C. That is, in the example of FIG. 6A, FIG. 6B, and FIG. 6C, 31 gas pipes are arranged in each fan-shaped portion (each region partitioned by dotted lines in FIG. 6B) in which the water pipe 11 is cross-sectioned along a horizontal plane.

That is, 31 of the first gas pipes 61 are arranged in the fan-shaped column portion of the water pipe 11 and configured so as to communicate the combustion exhaust gas introduction chamber A and the upper combustion exhaust gas passage chamber D. The combustion exhaust gas introduced from the combustion exhaust gas introduction port 15 to the combustion exhaust gas introduction chamber A passes through the plurality of first gas pipes 61, moves upward (from a passage O to a passage P in FIG. 5), and is once guided to the upper combustion exhaust gas passage chamber D.

31 of the second gas pipes 62 are arranged in the fan-shaped column portion of the water pipe 11 and configured so as to communicate the upper combustion exhaust gas passage chamber D and the lower combustion exhaust gas passage chamber B. Thus, the combustion exhaust gas from the upper combustion exhaust gas passage chamber D passes through the plurality of second gas pipes 62, moves downward (from a passage Q to a passage R in FIG. 5), and is once guided to the lower combustion exhaust gas passage chamber B.

31 of the third gas pipes 63 are arranged in the fan-shaped column portion of the water pipe 11 and configured so as to communicate the lower combustion exhaust gas passage chamber B and the combustion exhaust gas discharge chamber C. Thus, the combustion exhaust gas from the lower combustion exhaust gas passage chamber B passes through the plurality of third gas pipes 63, moves upward (from a passage S to a passage T in FIG. 5), and is discharged from the combustion exhaust gas exhaust port 19 via the combustion exhaust gas discharge chamber C.

According to the foregoing configuration, each group of gas pipes arranged in the fan-shaped portion in the horizontal plane can be freely arranged without being restricted by arrangement positions of the other gas pipes, so that as many gas pipes as possible can be installed in the fan-shaped area portion.

As a result, by arranging a large number of gas pipes, the cross-sectional area of the gas pipes can be reduced (the gas flow path is narrowed) to increase the gas flow velocity, and indirect heating within the water pipe between the combustion exhaust gas and the water can be performed without reducing the heat transfer area by increasing the number of gas pipes. Thus, the water in the water pipe can be efficiently warmed.

The first gas pipes 61, the second gas pipes 62, and the third gas pipes 63 are provided in the same number (31), and each gas pipe is also formed with the same diameter, so that the total cross-sectional area which becomes a flow path is the same. This is to reduce the resistance generated when the combustion exhaust gas moves from the first gas pipes 61 to the second gas pipes 62 and from the second gas pipes 62 to the third gas pipes 63.

Further, the upper end and the lower end of the water pipe 11 are configured to be connected by the flange portions, and the combustion exhaust gas introduction pipe (combustion exhaust gas introduction chamber) 20 and the combustion exhaust gas discharge pipe (combustion exhaust gas discharge chamber) 40 can be easily attached and detached to and from the water pipe 11 by the flange portions, so that each opening at both ends of the first gas pipes 61, the second gas pipes 62, and the third gas pipes 63 can be inspected from above and below.

By allowing each opening at both ends of the first gas pipes 61, the second gas pipes 62, and the third gas pipes 63 to be inspected, inspection of the inside of the gas pipe can be facilitated, and it becomes possible to easily clean the inside of the gas pipe using high pressure washing water from this part.

Figure 7:
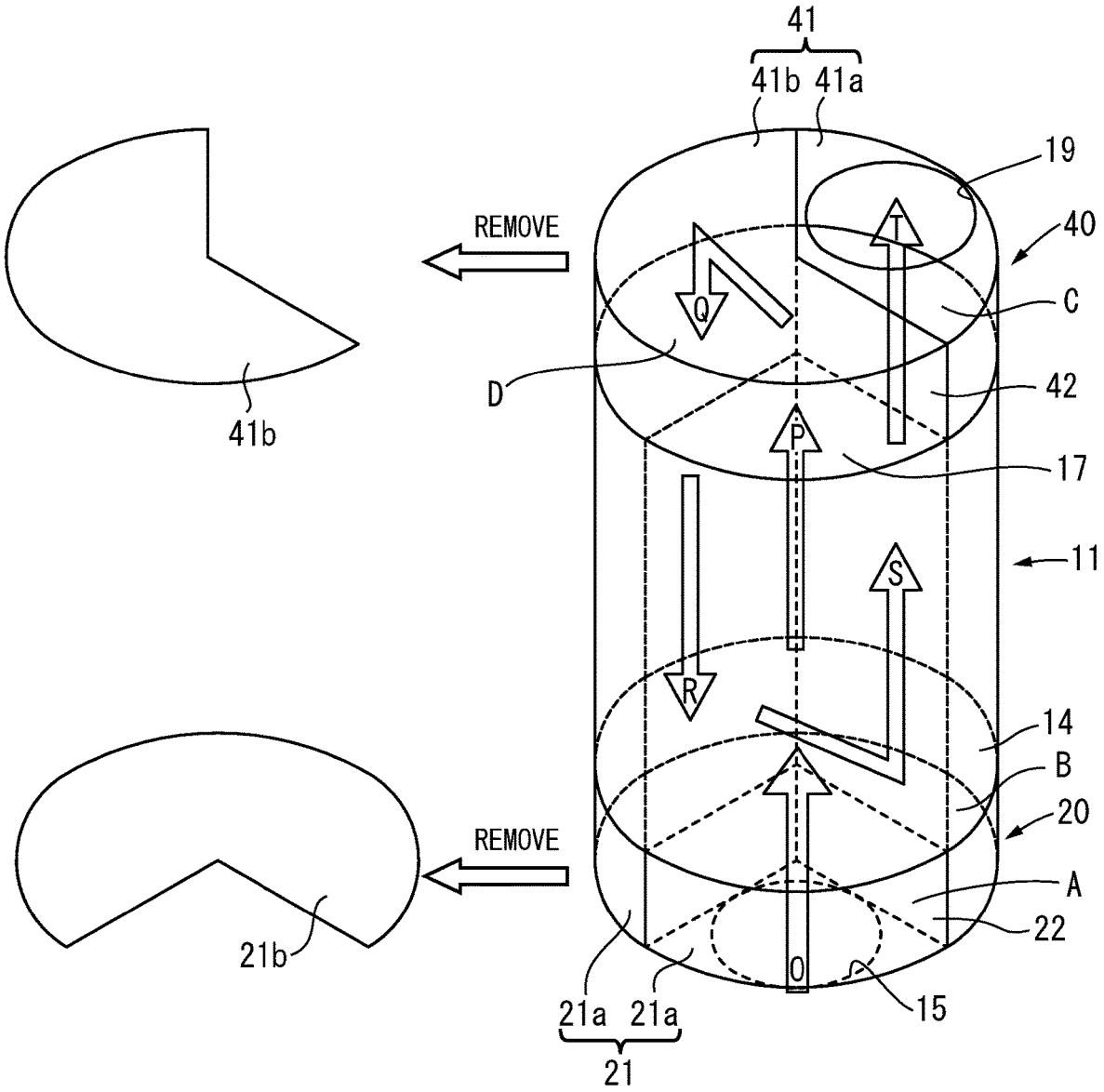
FIG. 7 is a model diagram showing an economizer in which part of a bottom plate and a top plate can be opened.
Figure 8:
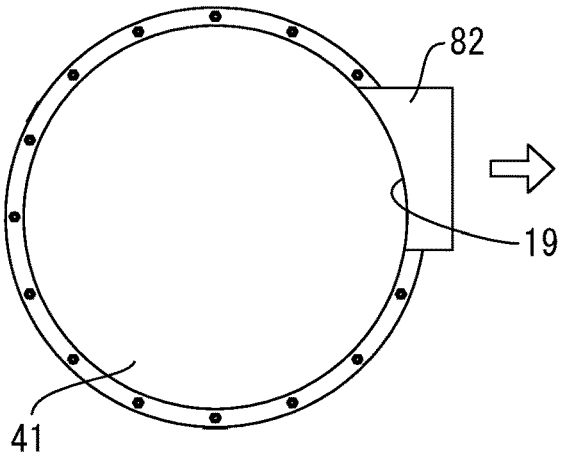
FIG. 8 is a plan explanatory diagram showing another embodiment of the economizer.
Figure 9:
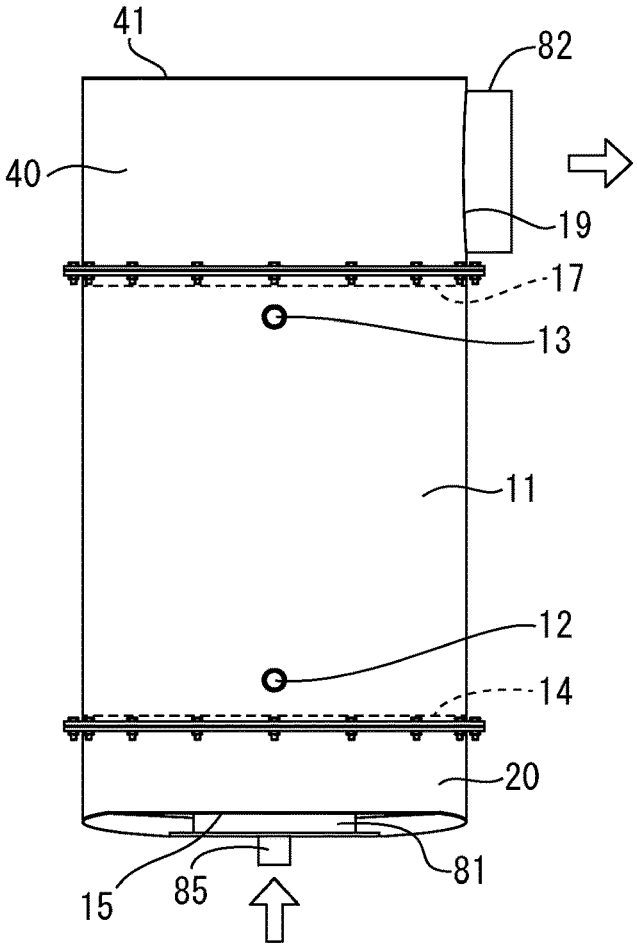
FIG. 9 is a front explanatory diagram of the economizer of FIG. 8.
Figure 10:
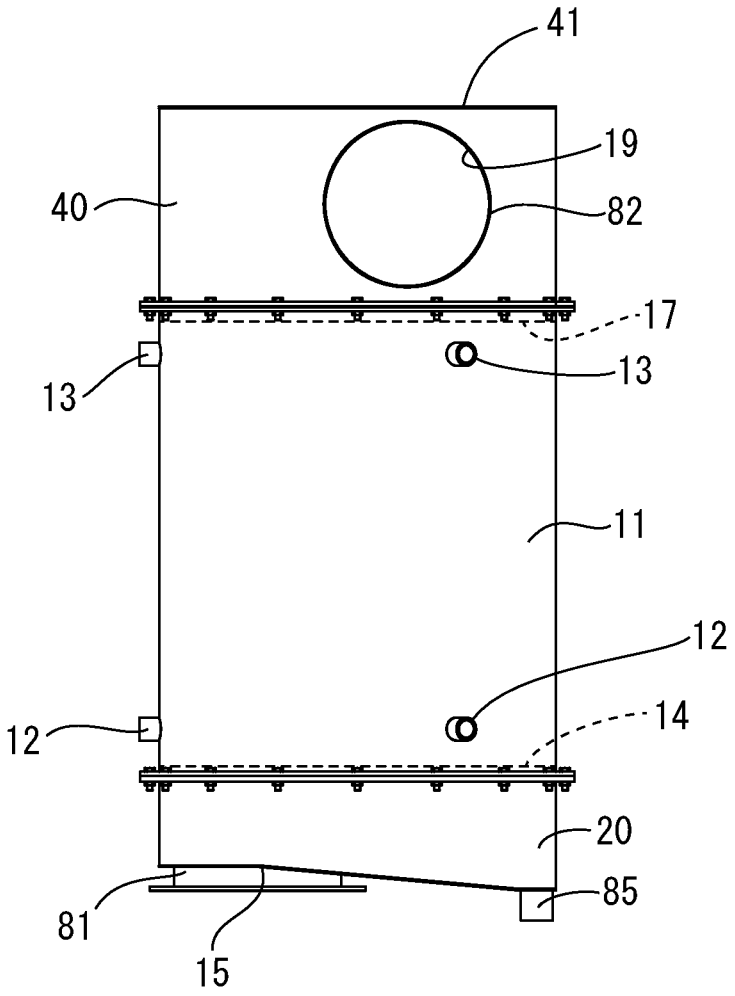
FIG. 10 is a side explanatory diagram of the economizer of FIG. 8.

Further, instead of the configuration that the combustion exhaust gas introduction pipe (combustion exhaust gas introduction chamber) 20 and the combustion exhaust gas discharge pipe (combustion exhaust gas discharge chamber) 40 can be attached and detached to and from the water pipe 11 by the flange portions, a part of the bottom plate 21 of the combustion exhaust gas introduction pipe 20 and a part of the top plate 41 of the combustion exhaust gas discharge pipe 40 may be attachably and detachably formed, as shown in FIG. 7.

That is, the bottom plate 21 is composed of a fixed portion 21*a* and an attaching/detaching portion (bottom surface lid) 21*b*, and the attaching/detaching portion 21*b* is configured to be removed in a state in which the pipe is connected to the combustion exhaust gas introduction port 15 formed in the fixed portion 21*a*. The attaching/detaching portion 21*b* is composed of a sealing structure that becomes a sealed state with respect to the lower combustion exhaust gas passage chamber B.

Similarly, the top plate 41 is composed of a fixed portion 41*a* and an attaching/detaching portion (upper surface lid) 41*b*, and the attaching/detaching portion 41*b* is configured to be removed in a state in which the pipe is connected to the combustion exhaust gas exhaust port 19 formed in the fixed portion 41*a*. The attaching/detaching portion 41*b* is composed of a sealing structure that becomes a sealed state with respect to the upper combustion exhaust gas passage chamber D.

The attaching/detaching portion (bottom surface lid) 21*b* of the bottom plate 21 and the attaching/detaching portion (upper surface lid) 41*b* of the top plate 41 have a shape in which the fixed portions (21*a*, 41*a*) having a fan shape with an interior angle of 120 degrees are removed from the disc-shaped lid bodies (bottom plate 21, top plate 41). The structure that the attaching/detaching portions 21*b*, 41*b* can be attached and detached to and from the combustion exhaust gas introduction pipe (combustion exhaust gas introduction chamber) 20 and the combustion exhaust gas discharge pipe (combustion exhaust gas discharge chamber) 40 respectively can be realized by connection with bolts and nuts or by hinges.

With the above structure, the lower ends of the second gas pipes 62 and the third gas pipes 63 can be inspected when the attaching/detaching portion 21*b* is removed from the combustion exhaust gas introduction pipe (combustion exhaust gas introduction chamber) 20. The upper ends of the first gas pipes 61 and the second gas pipes 62 can be inspected when the attaching/detaching portion 41*b* is removed from the combustion exhaust gas discharge pipe (combustion exhaust gas discharge chamber) 40.

As a result, inspection of the inside of each gas pipe can be facilitated, and it becomes possible to easily clean the inside of the gas pipe using high pressure washing water from this part.

Further, the inside of the gas pipe can be easily cleaned by light work of removing only the lightweight attaching/detaching portion 21*b* and attaching/detaching portion 41*b* in the state in which the pipe is connected to the combustion exhaust gas introduction pipe (combustion exhaust gas introduction chamber) 20 and the combustion exhaust gas discharge pipe (combustion exhaust gas discharge chamber) 40.

FIG. 8 to FIG. 12 show another example of the embodiment of the economizer. Parts having the same configurations as those of the economizer shown in FIG. 1 to FIG. 7 are denoted by the same reference signs and detailed description thereof will be omitted, and different configurations will be described below.

That is, the combustion exhaust gas exhaust port 19 provided on the upper surface side in the economizer of FIG. 1 to FIG. 7 is provided on a side surface side of the combustion exhaust gas discharge pipe 40, and the top plate 41 on the upper surface of the combustion exhaust gas discharge pipe 40 is formed so as to be openable by opening and closing operation. The top plate 41 is composed of a sealing structure that becomes a sealed state with respect to each of the combustion exhaust gas discharge chamber C and the upper combustion exhaust gas passage chamber D.

According to the above structure, by opening the top plate 41, the entire upper surface side of the combustion exhaust gas discharge pipe 40 can be opened in a state in which the combustion exhaust gas discharge pipe (combustion exhaust gas discharge chamber) 40 is connected to the combustion exhaust gas exhaust port 19, and all of the upper ends of the first gas pipes 61, the second gas pipes 62, and the third gas pipes 63 can be inspected.

Further, by connecting the cleaning pipe 85 to a lower surface of the lower combustion exhaust gas passage chamber B, when water for cleaning is supplied from the upper ends of the second gas pipes 62 and the third gas pipes 63 at the time when the top plate 41 is opened, the water flowing into the lower combustion exhaust gas passage chamber B can be recovered and discarded.

According to the structure of each economizer described above, the high-temperature combustion exhaust gas introduced from the introduction gas pipe 81 via the combustion exhaust gas introduction port 15 passes through the gas pipes 61 from the combustion exhaust gas introduction chamber A, flows upward, and flows into the upper combustion exhaust gas passage chamber D.

Subsequently, the combustion exhaust gas bounces off the upper combustion exhaust gas passage chamber D, passes through the second gas pipes 62, moves downward, and flows into the lower combustion exhaust gas passage chamber B.

The combustion exhaust gas bounces off in a collision, passes through the third gas pipes 63, moves upward, flows into the combustion exhaust gas discharge chamber C, and is discharged from the exhaust gas pipe 82 via the combustion exhaust gas exhaust port 19.

The water supplied from the inflow ports 12 of the water pipe 11 moves from bottom to top in the water pipe 11 while being warmed in contact with the circumference of the gas pipes 61, 62, 63, and flows out of the outflow ports 13.

According to the foregoing economizer, water supplied into the water pipe 11 can be efficiently warmed around the gas pipes by arranging, in the water pipe 11, a plurality of gas pipes (first gas pipes 61, second gas pipes 62, and third gas pipes 63) erected for circulating the combustion exhaust gas.

That is, since the gas pipes are arranged in the water pipe 11, the volume of the water pipe 11 can be made sufficiently large, so that the amount of water held (for example, 200 to 400 liters, and preferably 300 liters or more) can be increased. Even if the amount of water supplied per hour increases, there is an effect that a drop in water temperature due to the increased amount can be suppressed and sufficient warming (possible up to about 100° C.) can be maintained.

Further, the combustion exhaust gas is not directly guided into the water pipe 11 but only circulates through each gas pipe, so that dirt due to the combustion exhaust gas does not adhere to the inside of the water pipe 11.

Further, according to the example of the economizer shown in FIG. 1 to FIG. 6, the combustion exhaust gas introduction pipe 20 and the combustion exhaust gas discharge pipe 40 are respectively connected to the upper end and the lower end of the water pipe 11 via the flange portions, so that both can be easily detached at the flange portions by removing the bolts 71 and the nuts 72, and both ends of each of the first gas pipes 61, the second gas pipes 62, and the third gas pipes 63 can be inspected to facilitate the cleaning of the inside of the gas pipes.

Further, according to the example of the economizer shown in FIG. 7, both ends of each of the first gas pipes 61, the second gas pipes 62, and the third gas pipes 63 can be inspected by removing the lower surface lid 21*b* and the upper surface lid 41*b* to facilitate the cleaning of the inside of the gas pipes.

Further, according to the example of the economizer shown in FIG. 8 to FIG. 12, the entire upper surface side of the combustion exhaust gas discharge pipe 40 can be opened by opening and closing of the top plate 41 by providing the combustion exhaust gas exhaust port 19 on the side surface side of the combustion exhaust gas discharge pipe 40, and all of the upper ends of the first gas pipes 61, the second gas pipes 62, and the third gas pipes 63 can be inspected.

Figure 11:
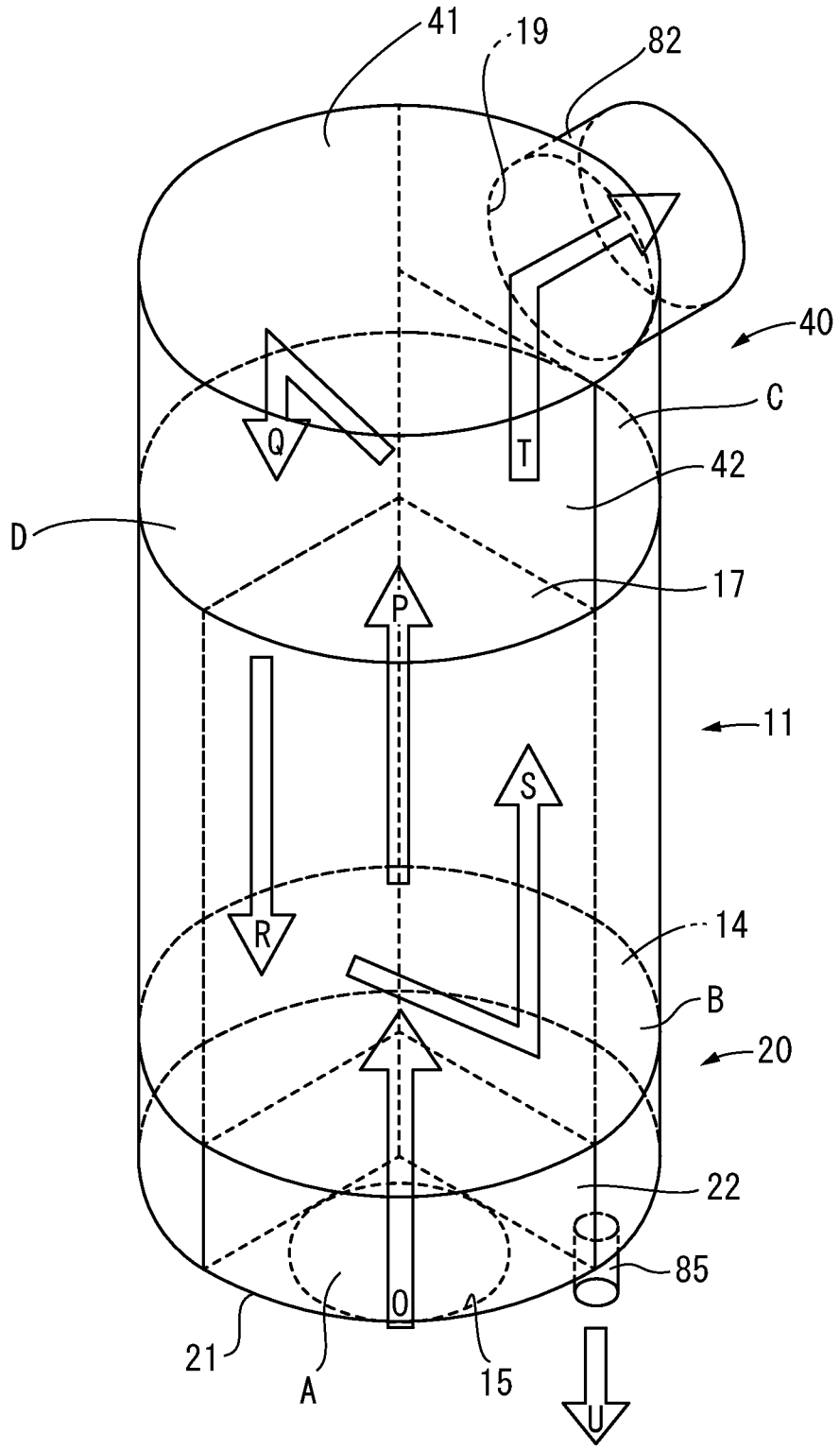
FIG. 11 is a model diagram of the economizer of FIG. 8.
Figure 12:
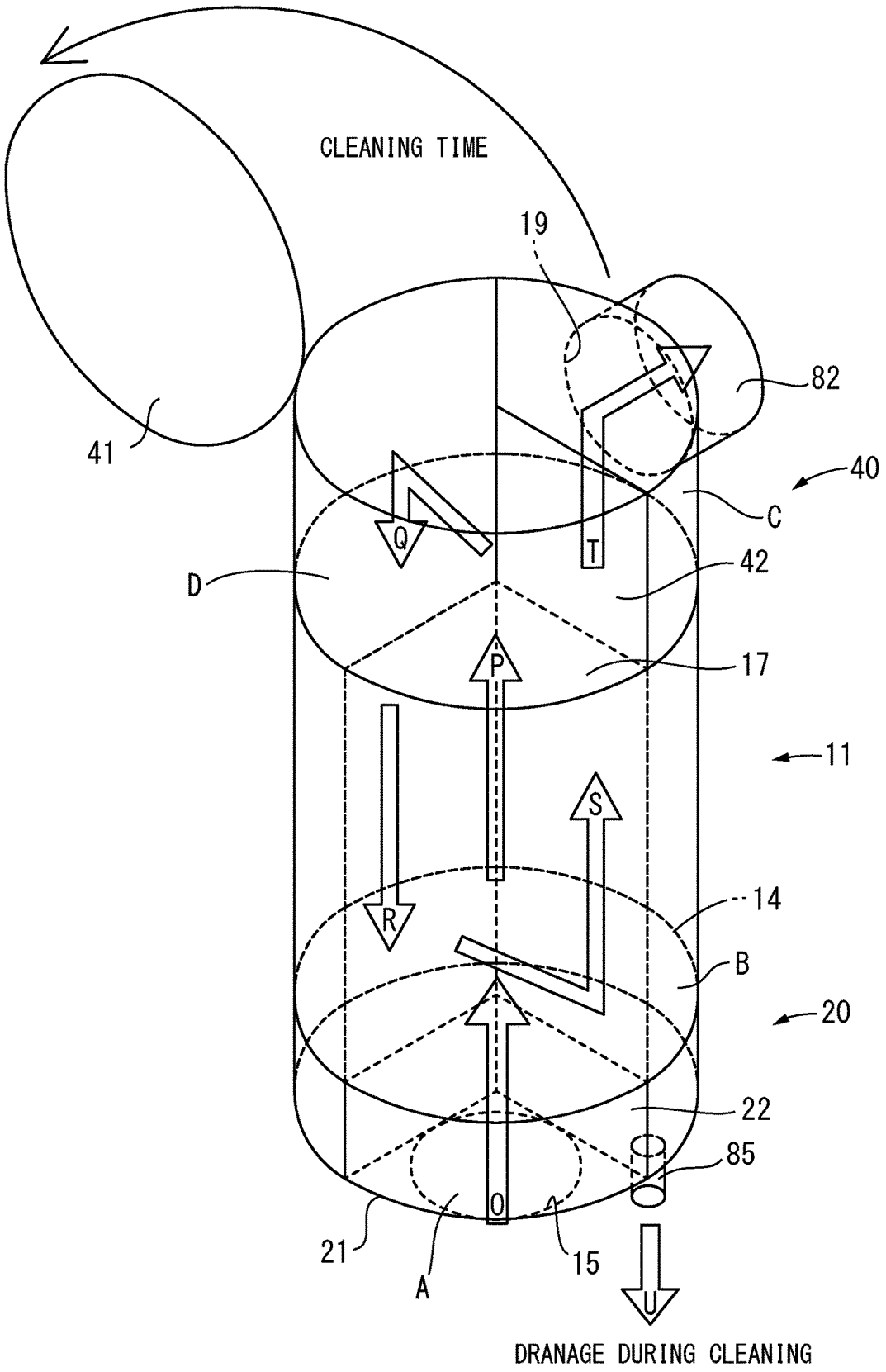
FIG. 12 is a model diagram of the economizer (when the top plate is opened) of FIG. 8.

When water for cleaning is supplied from the upper ends of the second gas pipes 62 and the third gas pipes 63, the water flowing into the lower combustion exhaust gas passage chamber B can be recovered from the cleaning pipe 85 and discarded (a passage U in FIG. 11 and FIG. 12).

The water pipe 11 of the foregoing economizer is composed of a water container in which atmospheric pressure is applied to the water surface of the water held and the water warmed in the water pipe flows out (is drained) from the outflow ports 13. However, the water pipe 11 may be composed of a pressure water container in which water is stored at a constant pressure different from the atmospheric pressure by supplying water by pump pressure and holding the water level by solenoid valve control. When the water pipe 11 is a pressure water container, the warmed water can be raised to about 150° C., which is 100° C. or higher.

Figure 13:
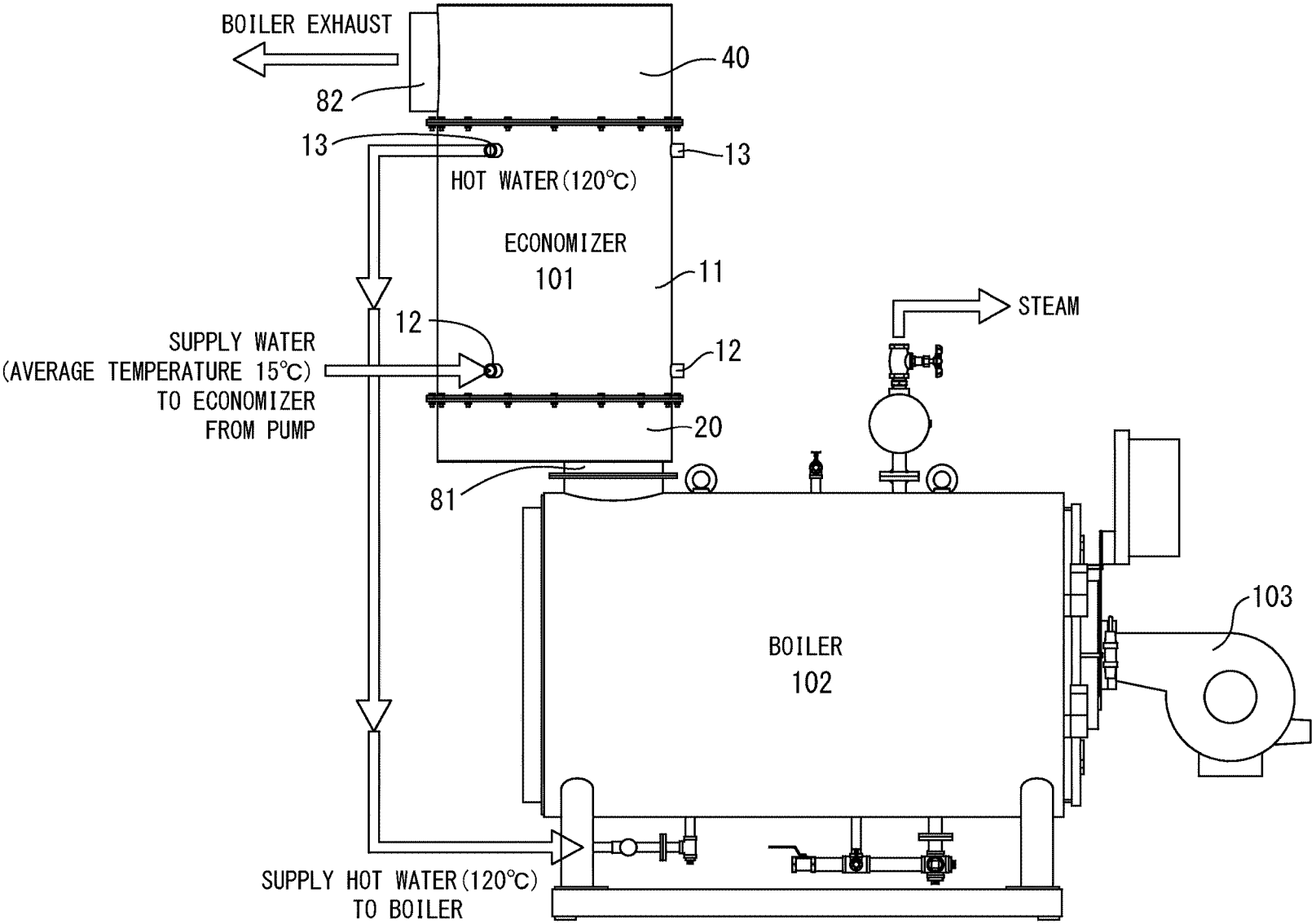
FIG. 13 is a side view showing a connection example of an economizer to a boiler.

Subsequently, a usage example of connecting the foregoing economizer to a boiler will be described with reference to FIG. 13.

A boiler 102 feeds the combustion gas from a blower 103 to the water supplied from the economizer 101 thereby discharging steam, and feeds the combustion exhaust gas from the combustion exhaust gas introduction pipe 20 of the economizer 101 and warms the water supplied to the economizer 101 of the foregoing structure.

In the economizer 101, the water having an average supply water temperature of 15 degrees is pressurized (for example, 0.98 MPa, 1.57 MPa, 2.94 MPa) via a pump (not shown) and supplied into the pressure container (water tank) 11. Since the supplied water is pressurized, the water is warmed up to about 120 degrees in the water tank 11 and discharged from the outflow ports 13.

The warmed water is supplied to the boiler 102 side, and then steam is generated from the warmed water of 120 degrees in the boiler. Since the steam is generated from the warmed water of 120 degrees, the combustion gas supplied from the blower 103 can be efficiently used and an energy saving effect can be achieved.

REFERENCE SINGS LIST

11 water pipe (pressure water container)
11*a*,11*b* flange portion
12 inflow port
13 outflow port
14 lower partition wall
15 combustion exhaust gas introduction port
17 upper partition wall
19 combustion exhaust gas exhaust port
20 combustion exhaust gas introduction pipe (combustion exhaust gas introduction chamber)
20*a* the flange portion
21 bottom plate
21*a* fixed portion
21*b* attaching/detaching portion (bottom surface lid) combustion exhaust gas discharge pipe (combustion exhaust gas discharge chamber)
40*a* flange portion
41 top plate
41*a* fixed portion
41*b* attaching/detaching portion (upper surface lid)
61 first gas pipes
62 second gas pipes
63 third gas pipes
81 introduction gas pipe
82 exhaust gas pipe
85 cleaning pipe
A combustion exhaust gas introduction chamber
B lower combustion exhaust gas passage chamber
C combustion exhaust gas discharge chamber
D upper combustion exhaust gas passage chamber

The invention claimed is:

1. An economizer for warming water by combustion exhaust gas generated by a boiler, comprising:

a cylindrical water pipe in which an inflow port and an outflow port are formed on a side surface and through which the water passes;

a combustion exhaust gas introduction pipe connected to a lower end position of the water pipe via a partition wall;

a combustion exhaust gas discharge pipe connected to an upper end position of the water pipe via a partition wall;

wherein the inside of the combustion exhaust gas introduction pipe is partitioned into a combustion exhaust gas introduction chamber facing a gas introduction port and a lower combustion exhaust gas passage chamber, and the inside of the combustion exhaust gas discharge pipe is partitioned into a combustion exhaust gas discharge chamber facing a gas exhaust port and an upper combustion exhaust gas passage chamber, a plurality of first gas pipes erected in the water pipe, penetrating the partition walls so as to put the combustion exhaust gas introduction chamber and the upper combustion exhaust gas passage chamber in communication with one another a plurality of second gas pipes erected in the water pipe, penetrating the partition walls so as to put the upper combustion exhaust gas passage chamber and the lower combustion exhaust gas passage chamber in communication with one another a plurality of third gas pipes erected in the water pipe, penetrating the partition walls so as to put the lower combustion exhaust gas passage chamber and the combustion exhaust gas discharge chamber in communication with one another wherein the combustion exhaust gas introduction chamber is formed with an area where the combustion exhaust gas introduction pipe is divided into three equal parts in a horizontal plane, and the combustion exhaust gas discharge chamber is formed with an area where the combustion exhaust gas discharge pipe is divided into three equal parts in a horizontal plane, so that passages where the first gas pipes, the second gas pipes, and the third gas pipes are erected each have the same area, whereas a bottom surface lid detachably attached to a position excluding the gas introduction port provided on a lower surface side of the combustion exhaust gas introduction pipe, and an upper surface lid detachably attached to a position excluding the gas exhaust port provided on an upper surface side of the combustion exhaust gas discharge pipe are provided, and upper ends of the first gas pipes, both ends of the second gas pipes, and lower ends of the third gas pipes can be inspected in a state in which the bottom surface lid and the upper surface lid are removed.

2. The economizer according to claim 1, wherein a cleaning pipe is connected to a lower surface of the lower combustion exhaust gas passage chamber.

3. The economizer according to claim 1, wherein the combustion exhaust gas introduction chamber and the combustion exhaust gas discharge chamber are fan-shaped in a horizontal plane.

4. The economizer according to claim 1, wherein a total of cross-sectional areas of the first gas pipes, a total of cross-sectional areas of the second gas pipes, and a total of cross-sectional areas of the third gas pipes are equal to one another.

5. The economizer according to claim 4, wherein the first gas pipes, the second gas pipes, and the third gas pipes are equal in number to one another.

6. The economizer according to claim 1, wherein the inflow port is formed at a lower position of the side surface of the water pipe, and the outflow port is formed at an upper position of the side surface of the water pipe.

7. The economizer according to claim 1, wherein the water pipe is composed of a pressure water container.

8. An economizer for warming water by combustion exhaust gas generated by a boiler, comprising:

a cylindrical water pipe in which an inflow port and an outflow port are formed on a side surface and through which the water passes;

a combustion exhaust gas introduction pipe connected to a lower end position of the water pipe via a partition wall;

a combustion exhaust gas discharge pipe connected to an upper end position of the water pipe via a partition wall;

wherein the inside of the combustion exhaust gas introduction pipe is partitioned into a combustion exhaust gas introduction chamber facing a gas introduction port and a lower combustion exhaust gas passage chamber, and the inside of the combustion exhaust gas discharge pipe is partitioned into a combustion exhaust gas discharge chamber facing a gas exhaust port and an upper combustion exhaust gas passage chamber, a plurality of first gas pipes erected in the water pipe, penetrating the partition walls so as to put the combustion exhaust gas introduction chamber and the upper combustion exhaust gas passage chamber in communication with one another a plurality of second gas pipes erected in the water pipe, penetrating the partition walls so as to put the upper combustion exhaust gas passage chamber and the lower combustion exhaust gas passage chamber in communication with one another a plurality of third gas pipes erected in the water pipe, penetrating the partition walls so as to put the lower combustion exhaust gas passage chamber and the combustion exhaust gas discharge chamber in communication with one another wherein the combustion exhaust gas introduction chamber is formed with an area where the combustion exhaust gas introduction pipe is divided into three equal parts in a horizontal plane, and the combustion exhaust gas discharge chamber is formed with an area where the combustion exhaust gas discharge pipe is divided into three equal parts in a horizontal plane, so that passages where the first gas pipes, the second gas pipes, and the third gas pipes are erected each have the same area, whereas the gas exhaust port is provided on a side surface side of the combustion exhaust gas discharge pipe to allow an upper surface of the combustion exhaust gas discharge pipe to be opened by an opening and closing operation of a top plate, so that upper ends of the first gas pipes, the second gas pipes, and the third gas pipes can be inspected when the top plate is opened.

* * * * *